US008151603B2

(12) United States Patent
Kang et al.

(10) Patent No.: US 8,151,603 B2
(45) Date of Patent: Apr. 10, 2012

(54) DOOR FOR WASHING MACHINE

(75) Inventors: Min-Gu Kang, Changwon-si (KR); Kyu-Chul Lee, Changwon-si (KR); Chang-Woo Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 456 days.

(21) Appl. No.: 12/385,556

(22) Filed: Apr. 10, 2009

(65) Prior Publication Data

US 2010/0031581 A1 Feb. 11, 2010

(30) Foreign Application Priority Data

Aug. 8, 2008 (KR) ..... 10-2008-0077942

(51) Int. Cl.
*D06F 37/28* (2006.01)

(52) U.S. Cl. ..... 68/196

(58) Field of Classification Search ..... 68/196; 134/200

See application file for complete search history.

(56) References Cited

U.S. PATENT DOCUMENTS

| | | | | |
|---|---|---|---|---|
| 2,450,670 | A * | 10/1948 | Loeb | 312/291 |
| 6,135,130 | A * | 10/2000 | Martineau | 134/113 |
| 7,320,186 | B2 * | 1/2008 | Schone | 34/603 |
| 7,559,156 | B2 * | 7/2009 | Renzo | 34/595 |
| 7,802,855 | B2 * | 9/2010 | Calmeise | 312/228 |
| 7,997,105 | B2 * | 8/2011 | Hill et al. | 68/196 |
| 2008/0028804 | A1 * | 2/2008 | Hoppe et al. | 68/139 |
| 2009/0121970 | A1 * | 5/2009 | Ozbek | 345/4 |

FOREIGN PATENT DOCUMENTS

| | | | |
|---|---|---|---|
| CN | 1683692 | * | 10/2005 |
| DE | 35 37 491 | * | 4/1987 |
| DE | 38 04 759 | * | 8/1989 |
| DE | 195 15 040 | * | 10/1996 |
| DE | 101 37 918 | * | 1/2003 |
| JP | 02-053713 | * | 2/1990 |
| JP | 2005-105164 | * | 4/2005 |
| JP | 2006-055314 | * | 3/2006 |
| JP | 2007-068810 | * | 3/2007 |
| JP | 2008-093074 | * | 4/2008 |
| KR | 2003025253 | * | 3/2003 |

OTHER PUBLICATIONS

European Patent Office 0 947 363 Oct. 1999.*
European Aptent Office 1 762 650 Feb. 3007.*

* cited by examiner

*Primary Examiner* — Frankie L Stinson
(74) *Attorney, Agent, or Firm* — McKenna Long & Aldridge LLP

(57) ABSTRACT

A door for a washing machine is disclosed. A door for a washing machine includes an inner frame having an opening with a predetermined size, an outer frame provided at a front surface of the inner frame, having an opening in communication with the opening of the inner frame, a glass member fitted between the inner and outer frames, covering the openings of the inner and outer frames, a decorative member provided at a front surface of the outer frame, having an opening in communication with the openings, and a front cover fitted between the decorative member and the outer frame, covering the openings of the inner and outer frames and the decorative member, the front cover having a positioning portion determining a position of the front cover coupled to the outer frame.

19 Claims, 4 Drawing Sheets

DOOR FOR WASHING MACHINE

CROSS REFERENCE TO RELATED APPLICATION

This application claims the benefit of the Patent Korean Application No. 10-2008-0077942, filed on Aug. 8, 2008, which is hereby incorporated by reference as if fully set forth herein.

BACKGROUND OF THE DISCLOSURE

1. Field of the Disclosure

The present invention relates to a washing machine. More particularly, the present invention relates to a door coupled to a washing machine.

2. Discussion of the Related Art

Generally, Washing machines are electric appliances that are used to clean laundry such as various items, fabrics, beddings, clothes or the like by using mechanical friction with detergent and wash water. In general, the washing machines are categorized based on the method used to load laundry, for example, a top loading-type and a front loading-type washing machine. A top loading type-washing machine includes a tub receiving laundry that is vertically oriented in a housing and the tub has a laundry introduction opening formed at a top portion. Thus, the laundry is loaded into the tub via the opening in communication with the tub. A front loading type-washing machine includes a tub receiving laundry that is horizontally oriented in a cabinet and the tub has a laundry introduction opening toward a front of the washing machine. Thus, the laundry is loaded into the tub via the opening formed at a front of the housing, in communication with the tub. A door may be installed at the housing of each of the top loading type and front type and the door opens and closes each of the openings.

Such the front loading type-washing machine has a compact design and substantially reduces damage to laundry fabric, compared with other kinds of types. Because of this advantage, of the two types, the front loading type-washing machine has been become more desirable. The front loading type-washing machine may be configured to supply hot air or steam to a horizontally oriented drum to enhance washing efficiency. As a result, the door of the front loading type washing machine may include substantially many parts to prevent the leakage of hot air or steam as well as wash water. In addition, the door has been designed to have a large size and many parts in order to enhance an exterior appearance of the washing machine. Accordingly, an assembly process of such the conventional door results in requiring complex assembly process and much time.

SUMMARY OF THE DISCLOSURE

Accordingly, the present invention is directed to a door for a washing machine.

An object of the present invention is to provide a door for a washing machine having an improved productivity.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a door for a washing machine includes an inner frame having an opening with a predetermined size; an outer frame provided at a front surface of the inner frame, having an opening in communication with the opening of the inner frame; a glass member fitted between the inner and outer frames, covering the openings of the inner and outer frames; a decorative member provided at a front surface of the outer frame, having an opening in communication with the openings; and a front cover fitted between the decorative member and the outer frame, covering the openings of the inner and outer frames and the decorative member, the front cover having a positioning portion determining a position of the front cover coupled to the outer frame.

The positioning portion may be configured of a handle of a door where a user's hand is inserted. The positioning portion may be configured of a recess formed at a side of the front cover.

The outer frame may include a seating portion where the positioning portion is inserted. The seating portion may be configured of a recess formed at a side of the outer frame.

The positioning portion may include a pocket member seated therein, the pocket member where the user's fingers are inserted. The pocket member may include a positioning projection extending therefrom and the outer frame may include a positioning groove receiving the positioning projection.

The decorative member may include at least one hook extended toward the outer frame, the hook engaged to the outer frame. The decorative member may be directly coupled to the inner frame to couple the front cover and outer frame to the inner frame simultaneously. Specifically, the decorative member may include a boss extended from a rear surface thereof, the boss secured to the inner frame directly. The boss may be directly secured to the inner frame, passing through the outer frame.

The decorative member may be configured to couple the front cover to the outer frame. The front cover may include a flange formed at an outer circumference thereof, the flange inserted between the decorative member and the outer frame. Here, an insulation member may be attached to the flange to prevent vibration transmitted to the front cover. A surface of the flange may be corroded to have a substantially large surface roughness.

The inner frame may include a positioning groove formed at an outer circumference of the opening and the glass member may include a positioning projection formed at an outer circumference thereof, the positioning projection received in the positioning groove. Alternatively, the inner frame may include a positioning projection formed at an outer circumference of the opening and the glass member may include a positioning groove formed at an outer circumference thereof, the positioning groove receiving the positioning. In this case, the positioning groove may be formed at the flange of the glass member inserted between the inner and the outer frame. The positioning projection may be formed at the flange of the inner frame formed at an outer circumference of the opening of the inner frame, the flange of the inner frame supporting a flange of the glass member.

The above configuration according to the present invention may enhance productivity of the door.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
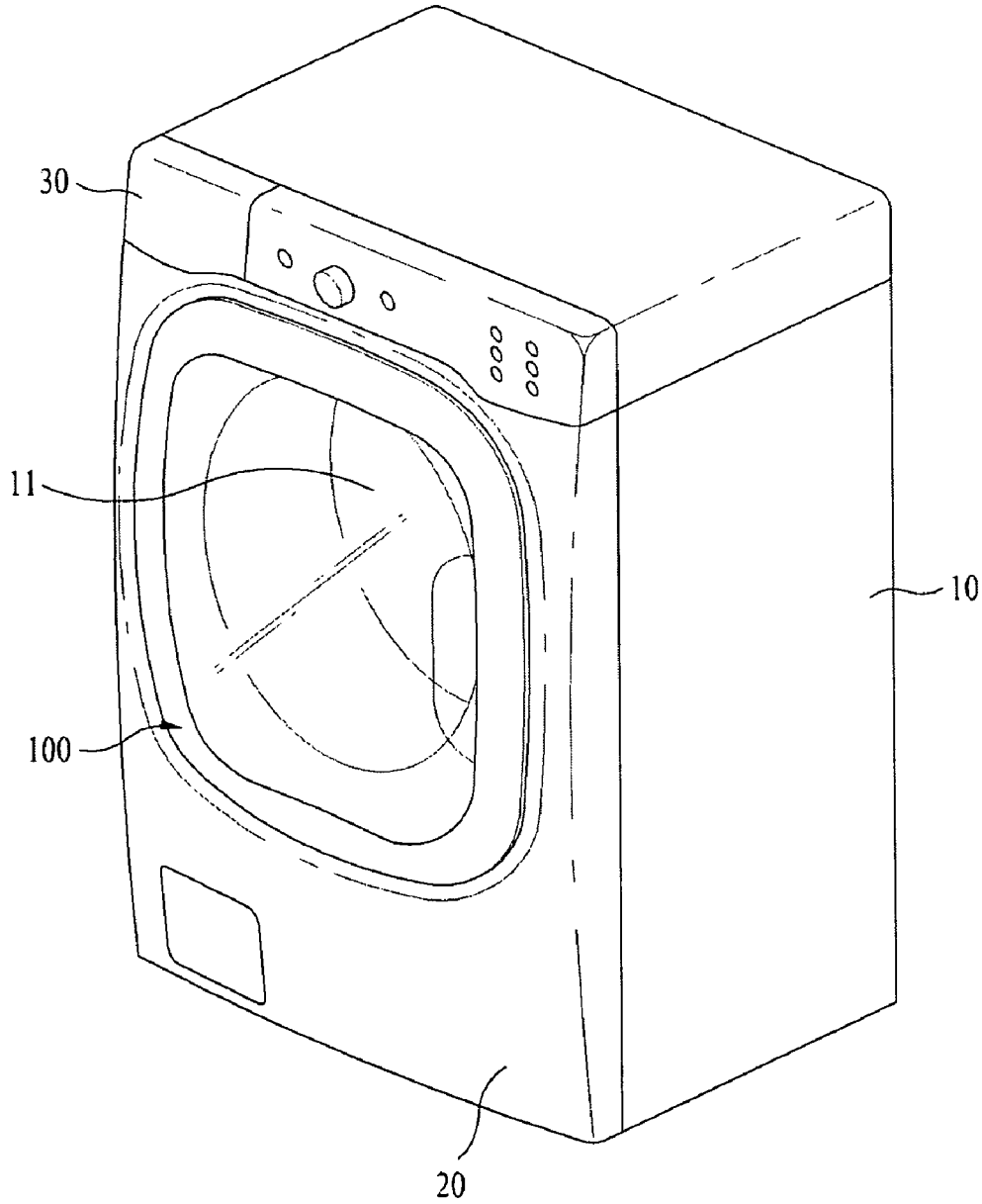
FIG. 1 is a perspective view illustrating a washing machine including a door according to an exemplary embodiment of the present invention.
Figure 2:
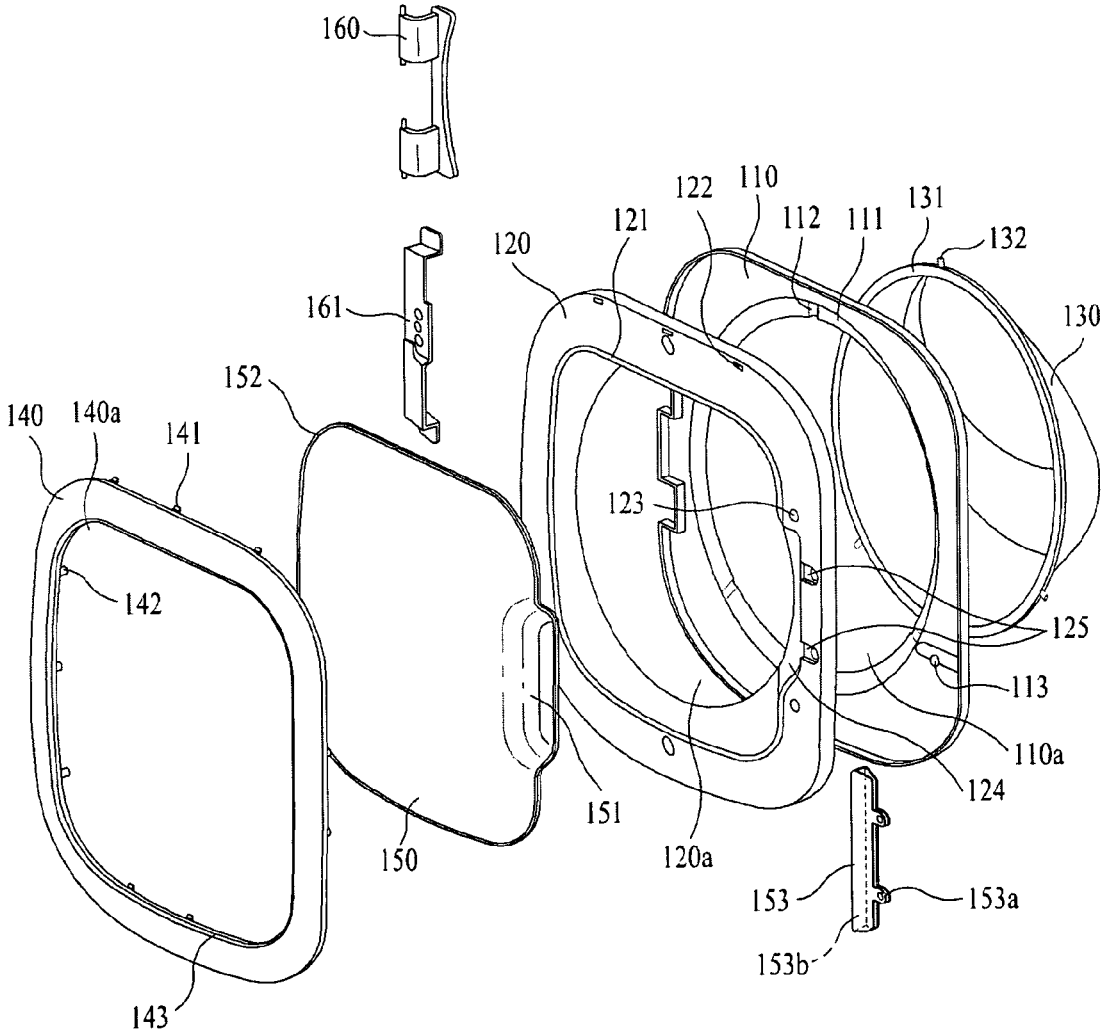
FIG. 2 is an exploded perspective view illustrating the door of FIG. 1.

FIG. 1 is a diagram schematically illustrating a washing machine including a door according to an exemplary embodiment of the present invention and FIG. 2 is an exploded perspective view illustrating the door according to the exemplary embodiment of the present invention.

A washing machine basically includes a housing 10, a tub (not shown) and a drum (not shown). The housing 10 defines an exterior appearance of the washing machine. The tub (not shown) is installed in the housing 10 and the drum (not shown) is rotatable within the tub. In addition, a front cover 20 is coupled to a front of the housing 10 and the front cover 20 forms a front portion of the washing machine. A control panel 30 is provided on an upper portion of the front cover 20 for a user to operate the washing machine. The tub receives wash water and the drum performs washing, rotating in the tub. The drum is horizontally oriented and its opening faces the front of the housing 10 and an opening 11 is formed in the housing 10, in communication with such the drum opening. The opening 11 is also closable by a door 100 coupled to the housing 10.

As shown in FIG. 1, the door 100 may be fabricated in a substantially rectangular shape. Such the rectangular-shaped door 100 enables the opening 11 and the drum opening to look large, which is advantageous to enhance the exterior appearance of the washing machine. Alternatively, the door 100 would be fabricated in a circular shape to have a compact size.

As shown in FIG. 2, the door 100 includes an inner frame 110. The inner frame 110 may have a rectangular shape, corresponding to the rectangular door 100. As mentioned above, the door 100 may have a circular shape and the inner frame may be formed in a circular shape, corresponding to the circular door. Here, the inner frame 110 has an opening 110*a* formed at its center and a user can look into the drum via the opening 110*a*.

An outer frame 120 may be coupled to a front of the inner frame 110. With the same reasons of the inner frame 110, the outer frame 120 may have a rectangular or circular shape and an opening 120*a* is formed at its center.

Also, a glass member 130 may be further provided to cover the openings 110*a* and 120*a* of the inner and outer frames. That is, the glass member 130 substantially closes the openings 110*a* and 120*a*. The glass member 130 prevents the wash water, hot air and steam of the drum from leaking via the openings 110 and 120*a*, enabling the user to look into the drum. Specifically, the glass member 130 is fitted between the inner and outer frames 110 and 120. For such the fitting, the glass member 130 has a flange 131 and the flange 131 is extended from an outer circumference of the glass member 130. The inner frame 110 has a flange 111 formed at an edge of the opening, corresponding to the flange 131 of the glass member 130. The flange 131 of the glass member 130 is seated on the flange 111 of the inner frame 110. At this time, the glass member 130 and the inner frame 110 includes a positioning structure to dispose the glass member 130 at a precise position on the inner frame 110. Specifically, such the positioning structure may be configured of a projection formed at either of the glass member 130 and the inner frame 110 and a groove formed at the other to accommodate the projection. For example, as shown in FIG. 2, a projection 132 may be formed at the glass member 130 and a groove 112 accommodating the projection 132 may be formed at the inner frame 110. If then, when the flange 131 is disposed on the flange 111, the coupling of the projection and the groove 112 enables the glass member 130 to be disposed at its precise position on the inner frame 110.

However, considering the property of the material, much part of the molded glass member 130 has to be cut out to form such the projection 132 and this could bring material waste and increase of works. While, the inner frame 110 is molded of plastic and it is relatively easy to form the projection at the inner frame 110. As a result, the inner frame 110 may include the projection formed on the flange 111 and the glass member may include the groove formed at a rear surface of the flange 131 and such the positioning structure may be more advantageous in consideration of the production.

A decorative member 140 may be provided at a front surface of the outer frame 120. With the same reason of the inner and outer frames 110 and 120, the decorative member 130 may has an opening 140*a* formed at its center. Also, the decorative member 140 might have various shapes it may have a rectangular or circular shape, corresponding to the overall appearance of the door 100 for identity of the exterior appearance of the door. Such the decorative member 140 covers a coupling hole formed at the outer frame 120 and other portions primarily, only to enhance the exterior appearance of the door. In addition, various kinds of patterns and colors and other kinds of members may be attached to the decorative member 140 to enhance the overall exterior appearance of the washing machine.

The front cover 150 covers the opening 140*a* of the decorative member 140 as well as the openings 110*a* and 120*a* of the inner and outer frames 110 and 120. As a result, the front cover 150 closes the openings 110*a*, 120*a* and 140*a*. Here, the front cover 150 may be formed of transparent material. Because of that, the front cover 150 prevents the wash water, hot air and steam of the drum from leaking out via the openings 110*a*, 120*a* and 140*a*, enabling the user to look inside the drum together with the glass member 130. Moreover, the front cover 150 prevents foreign substances from coming into the door via the openings 110*a*, 120*a* and 140*a*. By extension, the front cover 150 may enhance the overall exterior appearance of the door 110, because the front cover 150 is positioned on an identical section to the decorative member 140 for the front of the door 100 to have a single surface.

The front cover 150 is positioned on the outer frame 120 basically. However, the front cover 150 is provided to cover the openings 110*a*, 120*a* and 140*a* of the relating components as mentioned above and thus the size of the front cover 150 is not substantially larger than the sizes of the relating components, specifically, the frames and decorative member. That is, the front cover 150 is smaller than the other components and it is difficult for the front cover 150 to have an auxiliary separate structure for its coupling. As a result, it is not easy to determine the position of the front cover 150 on the outer frame 120. Because of that, the front cover 150 includes a positioning portion 151 and such the positioning portion 151 determines the position of the front cover 150 coupled to the outer frame 120. Such the positioning portion 151 may be embodied in various structures but it may be embodied as a handle of the door the user's hand is inserted. Specifically, the positioning portion 151 is provided at a side of the front cover 150 and a predetermined space may be recessed enough for the user's hand to be inserted. Relating to such the positioning portion 151, the outer frame 120 includes a seating portion 124 the positioning portion 151 is inserted. Correspondingly, the seating portion 124 may be configured of a recess formed at a side of the outer frame 120, corresponding to the positioning portion 151. Then, once the positioning portion 151 is inserted in the seating portion 124, the front cover 150 could be disposed at a precise coupling position at the outer frame 120. The handle required in the door may be employed as the positioning portion, such that the front cover 150 may be coupled to the outer frame 120 precisely, even without any auxiliary positioning structures. This configuration enables the door to be assembled smoothly without the increase of parts required in fabricating the door.

In addition, a pocket member 153 may be seated in the positioning portion 151 and the pocket member 153 forms a predetermined space 153*b* for the user's fingers to be inserted. When trying to open or close the door 100, the user substantially apply the force to the door 100 through the pocket member 153 substantially. The positioning portion 151 may compose a handle of the door 100 substantially, together with the pocket member 153, and also the positioning portion 151 determines the position of the pocket member 153. For the assembly convenience sake, the pocket member 153 includes a positioning projection 153*a* and the positioning projection 153*a* is extended from a body of the pocket member 153. The outer frame 120 includes a positioning groove 125 receiving the positioning projection 153*a* correspondingly. Once the positioning projection 153*a* is received in the positioning groove 125, the position of the pocket member 153 may be determined precisely.

After the front cover 150 is disposed on the outer frame 120, the decorative member 140 is coupled to the front of the outer frame 120. Such the coupling makes the front cover 150 fitted between the decorative member 140 and the outer frame 120. For such the fitting, the front cover 150 includes a flange 152 and the flange 152 is extended from an outer circumference of front cover 150. Also, the outer frame 120 includes a flange 121 and the flange 121 is formed at an edge of the opening 120*a* of the outer frame 120. The flange 152 of the front cover 150 is seated on the flange 121 of the outer frame 120. Here, the decorative member 140 includes a hook 141 and the hook 141 formed at its rear surface. Corresponding to the hook 141, the outer frame 120 includes an engaging groove 122. As the hook 141 is engaged to the engaging groove 122, the decorative member 140 is coupled to the outer frame 120. Here, the decorative member 140 includes a flange 143 formed at an edge of its opening 140*a*. When the decorative member 140 is coupled to the outer frame 120, the flange 143 of the decorative member 140 closely contacts with the flange 152 of the front cover. Then, the flange 152 of the front cover is fitted between the flanges 121 and 143 of the outer frame and the decorative member, which may complete the coupling of the front cover.

Figure 3:
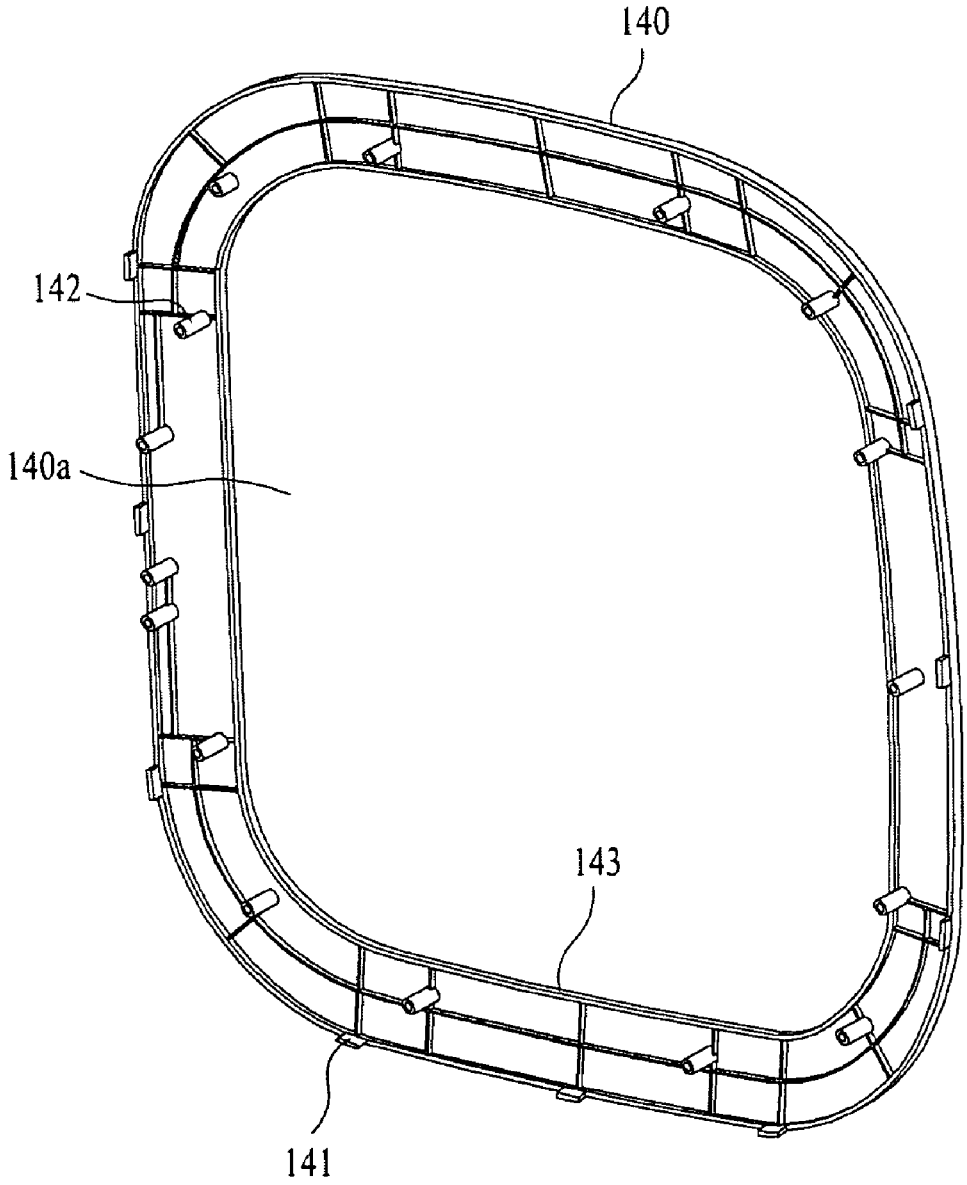
FIG. 3 is a rear view illustrating a decorative member of the door.

In addition, the decorative member 140 includes bosses 142 and the boss 142 is extended from a rear surface of the decorative member 140. The boss 142 passes a through hole 124 formed at the outer frame 120 and it reaches the inner frame 110. Such the boss 142 is shown in FIG. 3 more specifically. The inner frame 110 includes a plurality of coupling holes 113 corresponding to the bosses 142. A coupling member (not shown) inserted in the through hole 123 is secured to the boss 142. Such the boss 142 directly couples the decorative member 140 to the inner frame 110. As the decorative member 140 is seated on the outer frame 120 by using the hook 141, the front cover 150 and the pocket member 140 are also seated on the outer frame 120. That is, the decorative member 140 composes the front assembly of the door, together with the outer frame 120 and the front cover 150. In addition, the decorative member 140 seats such the front assembly, that is, the decorative member 140, the outer frame 120 and the front cover 150 on the inner frame 110. At this time, the glass member 130 is also fitted between the inner frame 110 and the outer frame 120. Using only the single decorative member 140, all the components of the door 100 may be coupled each other and the assembly works of such the door may be simple.

In the meanwhile, vibration generated during the operation of the washing machine is transmitted to the door 100. Such the vibration may make the flange 152 of the front cover 150 vibrate between the other flanges 121 and 143. Such the vibration could generate friction between the flange 152 of the front cover 150 and the other flanges 121 and 143, which could generate noise and worn-out portions of the flanges would be generated. Because of that, insulation members may be attached to surfaces of the flange 152 which face the other flanges 121 and 143, respectively. The insulation member insulates the vibration transmitted to the front cover 150. Instead of the insulation member, a damping member may be provided at the front cover 150 to dampen the vibration. As a result, there will be no friction between the front cover 150 and the other flanges 121 and 143 such that the noise and worn-out portion may be prevented. Here, at least one surface of the flange 152 of the front cover 150 may be corroded by chemicals to have a high roughness. Both surfaces of the flange 152 may be corroded. Such the high roughness substantially increases coefficient of friction of the surfaces of the flange 152 and the surfaces of the flange 152 is not slipping on surfaces of the other flanges 121 and 143 even with the applied vibration. As a result, the corroded surface may prevent the noise and worn-out portion generated by the friction.

The door 100 is connected with the housing 10 of the washing machine by a hinge 160. The hinge 160 is provided between the inner frame 110 and the outer frame 120. For the securing connection, the hinge 160 is installed between the frames 110 and 120 by using a bracket 161. Specifically, an end of the hinge 160 is rotatably connected to an outer or inner surface of the housing 10 and the other end of the hinge 160 is rotatably connected to the door 100, specifically, the frames 110 and 120. Then, the door 100 is rotatable with respect to the housing 10 by the hinge 160 and it is also rotatable with respect to the hinge 160.

Figure 4:
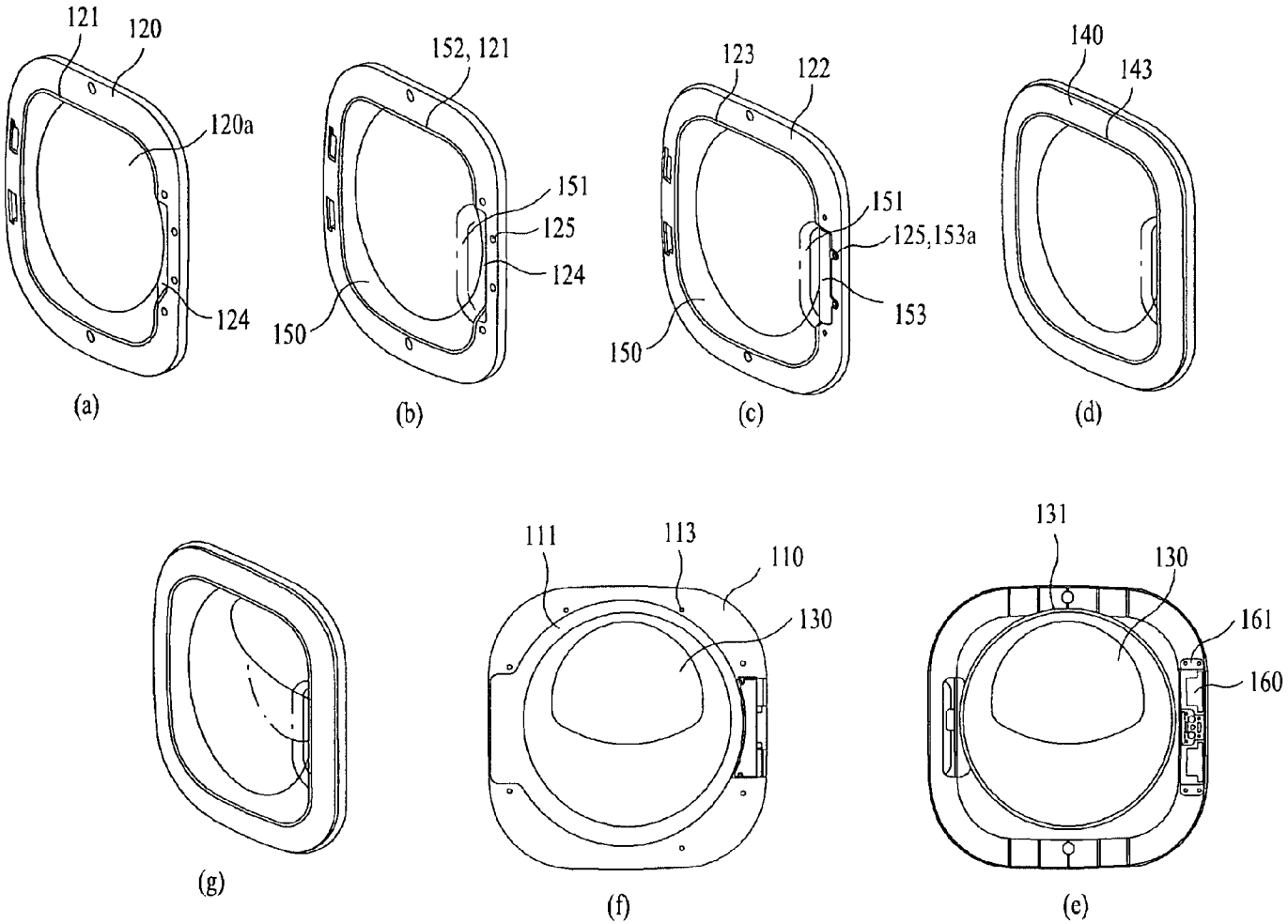
FIG. 4 is a diagram illustrating an assembly process of the door.

The assembly process of the door according to the present invention will be described. FIG. 4 is a diagram illustrating assembly processes of the door in detail.

In reference to FIG. 4(*a*), the outer frame 120 is disposed at a proper position. Hence, as shown in FIG. 4(*b*), the front cover 150 is positioned on the outer frame 120 to cover the opening 120*a* of the outer frame 120. At this time, the positioning portion 151 of the front cover 150 is inserted in the seating portion 124 of the outer frame such that the position of the front cover 150 coupled to the outer frame 120 may be determined precisely. Simultaneously, the flange 152 of the front cover is seated on the flange 121 of the outer frame.

As shown in FIG. 4(*c*), the pocket member 153 substantially corresponding to the handle is inserted in the positioning portion 151. At this time, the positioning projection 153*a* of the pocket member 153 is received in the positioning groove 125 of the outer frame 120 such that the pocket member 153 may be positioned on the outer frame 120 precisely.

Hence, as shown in FIG. 4(*d*), the decorative member 140 is coupled to the outer frame 120. Here, for the coupling between the decorative member 140 and the outer frame 120, the hook 141 shown in FIG. 2 is engaged to the engaging groove 122 of the outer frame 120. The flange 143 of the decorative member covers the flange 152 of the front cover 150. Also, the body of the decorative member 140 covers the overall portion of the pocket member 153 positioned on the front cover 150. As a result, the front cover and the pocket member 153 may be fitted between the decorative member 140 and the outer frame 120, not being separated from each other. In other words, the coupling of the decorative member 140 to the outer frame 120 substantially enables the coupling of the front cover 150 and the pocket member 153 to the decorative member 140 and the outer frame 120. These components form a single front sub assembly. If the outer frame 120 is coupled to the inner frame 110 and the glass member 130 primarily to form, namely, a rear sub assembly, the large volume and weight of the glass member 130 composing such a rear sub assembly could cause quite difficulties to an assembly line worker during a following assembly process. In contrast, such the front sub assembly has the relatively small volume, which would be dealt with by the assembly line worker smoothly and conveniently. As a result, the front sub assembly may enable the series of the door assembly processes to be simple and efficient.

Next, as shown in FIG. 4(*e*), the sub assembly is turned over and the glass member 130 is disposed to a rear of the turned-over sub assembly, specifically, a rear surface of the outer frame 120. Here, the hinge 160 is secured to a predetermined portion of the rear of the outer frame 120 by the bracket 161. Hence, as shown in FIG. 4(*f*), the inner frame 110 is coupled to the outer frame 120 having the glass member 130 fitted thereto. As mentioned above in reference to FIGS. 2 and 3, when the decorative member 140 is coupled to the outer frame 120, the boss 142 passes the through hole 125 of the outer frame 120 and it is exposed outside of the outer frame 120. For the coupling of the outer and inner frames, the securing member inserted in the securing hole 113 of the inner frame is secured to the boss 142. Also, the flange 111 of the inner frame 110 covers the flange 131 of the glass member 130 such that the glass member 130 is fitted between the inner and outer frames 110 and 120 securely not to be separate. That is, the decorative member 140 is configured to couple the front sub assembly, together with the glass member 130, to the inner frame 110 one time by using the boss 142. The single coupling process by using the single member, that is, the decorative member substantially completes the overall assembly process of the door 100 and thus the above assembly process according to the present invention mentioned above may be said to be simple and efficient.

The door 100 is assembled completely according to the above assembly process, as shown in FIG. 4(*g*) and then the door is connected to the housing by the hinge 160 such that the door 100 may be rotatable with respect to the washing machine.

The configuration mentioned above may delete unnecessary parts and processes and the components of the door may have applicable structures which is advantageous to fabricate. As a result, the production cost may be reduced and the production work may be simple as well as efficient. Owing to these reasons, productivity of the door for the washing machine may be improved noticeably.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A door for a washing machine comprising:

an inner frame having an opening with a predetermined size;

an outer frame provided at a front surface of the inner frame, having an opening in communication with the opening of the inner frame;

a glass member fitted between the inner and outer frames, covering the openings of the inner and outer frames;

a decorative member provided at a front surface of the outer frame, having an opening in communication with the openings; and a front cover fitted between the decorative member and the outer frame, covering the openings of the inner and outer frames and the decorative member, the front cover having a positioning portion determining a position of the front cover coupled to the outer frame, wherein the positioning portion comprises a pocket member seated in the positioning portion and allowing user's fingers to be inserted therein.

2. The door of claim 1, wherein the positioning portion is a handle of a door where a user's hand is inserted.

3. The door of claim 1, wherein the positioning portion comprises a recess formed at a side of the front cover.

4. The door of claim 1, wherein the outer frame comprises a seating portion where the positioning portion is inserted.

5. The door of claim 4, wherein the seating portion comprises a recess formed at a side of the outer frame.

6. The door of claim 1, wherein the pocket member comprises a positioning projection extending therefrom and the outer frame comprises a positioning groove receiving the positioning projection.

7. The door of claim 1, wherein the decorative member comprises at least one hook extended toward the outer frame, the hook engaged to the outer frame.

8. The door of claim 1, wherein the decorative member is directly coupled to the inner frame to couple the front cover and outer frame to the inner frame simultaneously.

9. The door of claim 1, wherein the decorative member comprises a boss extended from a rear surface thereof, the boss secured to the inner frame directly.

10. The door of claim 1, wherein the decorative member comprises a boss directly secured to the inner frame, passing through the outer frame.

11. The door of claim 1, wherein the decorative member is configured to couple the front cover to the outer frame.

12. The door of claim 1, wherein the front cover comprises a flange formed at an outer circumference thereof, the flange inserted between the decorative member and the outer frame.

13. The door of claim 12, wherein an insulation member is attached to the flange to prevent vibration transmitted to the front cover.

14. The door of claim 12, wherein a surface of the flange is corroded to have a substantially large surface roughness.

15. The door of claim 1, wherein the inner frame comprises a positioning groove formed at an outer circumference of the opening and the glass member comprises a positioning projection formed at an outer circumference thereof, the positioning projection received in the positioning groove.

16. The door of claim 1, wherein the inner frame comprises a positioning projection formed at an outer circumference of the opening and the glass member comprises a positioning groove formed at an outer circumference thereof, the positioning groove receiving the positioning.

17. The door of claim 16, wherein the positioning groove is formed at the flange of the glass member inserted between the inner and the outer frame.

18. The door of claim 17, wherein the positioning projection is formed at a flange of the inner frame formed at an outer circumference of the opening of the inner frame, the flange of the inner frame supporting the flange of the glass member.

19. The door of claim 1, wherein the inner frame, outer frame, decorative member and front cover have a rectangular shape, respectively.

* * * * *